United States Patent [19]

Pietro

[11] Patent Number: 4,718,786

[45] Date of Patent: Jan. 12, 1988

[54] TRANSPORT DEVICE FOR A PRINT UNIT OF PRINTING MACHINES

[75] Inventor: Musso Pietro, Ivrea, Italy

[73] Assignee: Ing. C. Olivetti & C., S.p.A., Ivrea, Italy

[21] Appl. No.: 866,255

[22] Filed: May 23, 1986

[30] Foreign Application Priority Data

May 29, 1985 [IT] Italy ..... 67490 A/85

[51] Int. Cl.[4] ..... B41J 25/28

[52] U.S. Cl. ..... 400/320; 400/328

[58] Field of Search ..... 400/320, 328, 322, 569, 400/903

[56] References Cited

U.S. PATENT DOCUMENTS

| | | | |
|---|---|---|---|
| 4,318,625 | 3/1982 | Survant | 400/322 |
| 4,383,778 | 5/1983 | Costa | 400/568 X |
| 4,395,151 | 7/1983 | Krenz | 400/320 |
| 4,507,102 | 3/1985 | Geis et al. | 400/320 X |

FOREIGN PATENT DOCUMENTS

| | | | |
|---|---|---|---|
| 0118277 | 9/1984 | European Pat. Off. . | |
| 29690 | 2/1983 | Japan | 400/328 |

OTHER PUBLICATIONS

General Service Manual–Olivetti ET 111.

Design of Machine Elements, 5th ed, Prentice-Hall, Englewood Cliffs, N.J., 1978, pp. 433–434, by Spotts.

Product Engineering, Oct. 26, 1959, pp. 71–75, "18 Ways to Control Backlash in Gearing", by Gutmann.

*Primary Examiner*—Charles A. Pearson

*Attorney, Agent, or Firm*—Banner, Birch, McKie & Beckett

[57] ABSTRACT

The device comprises an electric motor whose rotor is capable of rotating selectively in either direction and a transmission unit which comprises a sleeve carrying a gear at an input end in mesh with a pinion on the motor shaft. At the output end of the sleeve a toothed pulley is engaged with a tensioned, toothed belt for moving the print unit back and forth. The sleeve is journalled on a shaft which can shift laterally at the input end and is urged by a spring and lever to shift in the sense forcing the gear into mesh with the pinion, thereby to minimize the radial clearance between the pinion and the gear.

7 Claims, 6 Drawing Figures

TRANSPORT DEVICE FOR A PRINT UNIT OF PRINTING MACHINES

BACKGROUND OF THE INVENTION

The present invention relates to a transport device for a print unit of printing machines, in particular for typewriters, comprising a select motor for displacement of the print unit in two directions.

In a known transport device, the transport motor comprises a pinion engaged with a toothed wheel of a transmission unit. The transmission unit comprises a toothed pulley which is coaxial with the gear and which engages with a toothed belt for transmitting the movement to the print unit. The toothed pulley and the gear are rotatable on a shaft which is fixed to the frame of the machine and the stator of the transport motor is mounted on an eccentric in order to take up clearances between the pinion and the gear. That arrangement suffers from the disadvantage that, as a result of wear, clearance between the pinion and the gear progressively increasess and thus the pinion-gear coupling means becomes noisy and suffers from a lack of precision. Periodic adjustment of the eccentric is therefore necessary in order to reduce the clearances.

SUMMARY OF THE INVENTION

An aim of the present invention is therefore to provide a transport device which is simple, compact and economic and which also permits quick, silent and highly precise positioning of the print unit.

That aim is achieved by the transport device according to the present invention, which comprises a transmission unit having a pinion-gear coupling means, and a self-regulating device for automatically taking up radial clearances between the pinion of the transport motor and the gear.

BRIEF DESCRIPTION OF THE DRAWING

A preferred embodiment of the invention is set forth in the following description which is given by way of non-limiting example and with reference to the drawing in which.

DESCRIPTION OF THE PREFERRED EMBODIMENT

Figure 1:
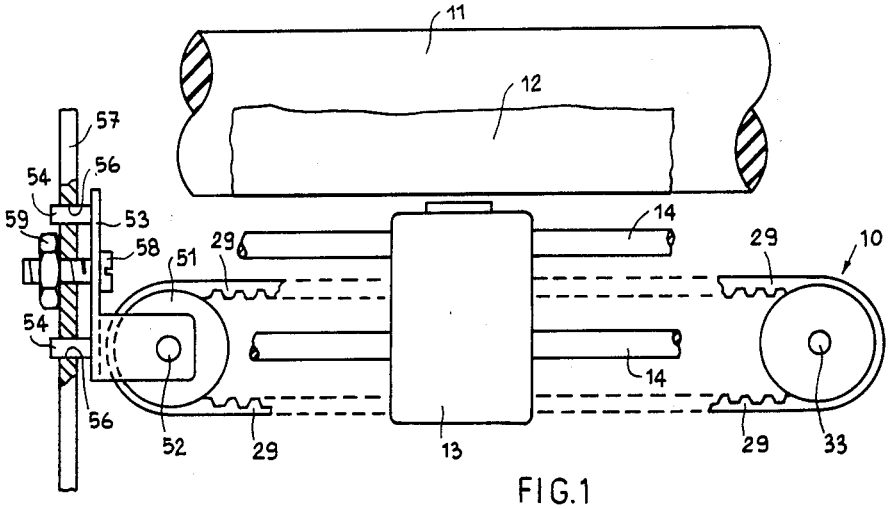
FIG. 1 is a partial diagrammatic view of a typewriter on which the transport device according to the invention is mounted.

Referring to FIG. 1, a transport device according to the invention is generally indicated by reference numeral 10 and is applied to a typewriter comprising a platen roller 11 on which a sheet of paper 12 is carried. A print unit 13 comprising for example a character-carrying daisywheel of the type described in published European patent application No. EP 0 118 277 is movable in two directions on two cylindrical guides 14 which are parallel to the platen roller 11.

Figure 2:
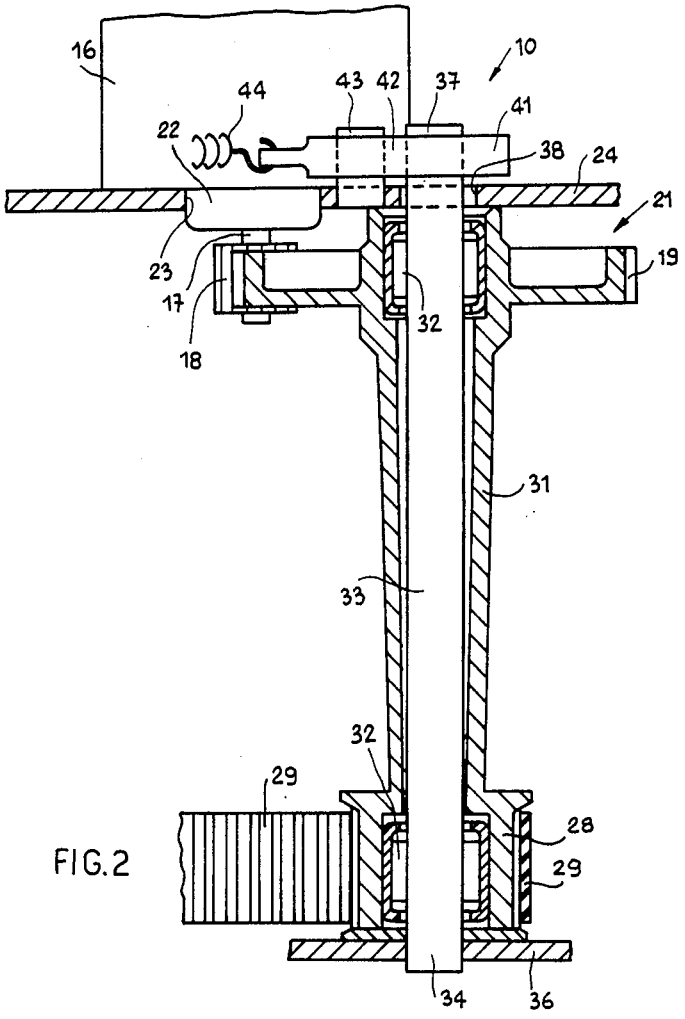
FIG. 2 is a partly sectional plan view of the device shown in FIG. 1.
Figure 4:
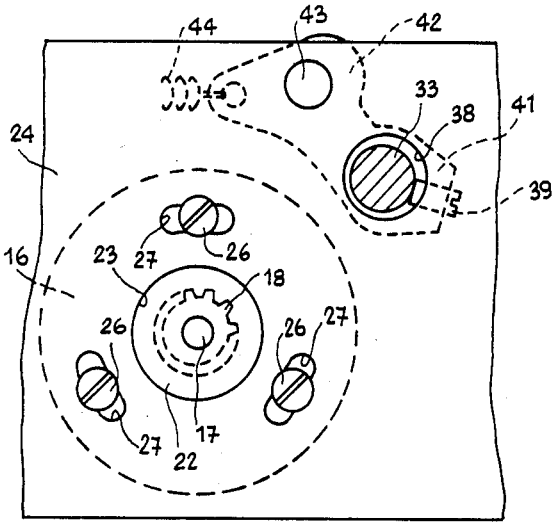
FIG. 4 is a partial front view of other details of the device shown in FIG. 2.

The transport device 10 (see FIG. 2) comprises a d.c. transport motor 16 having a rotor with a shaft 17 on which a pinion 18 is fixed; the pinion 18 can mesh with the teeth of a gear 19 of a transmission unit 21. The motor 16 comprises a stator provided with a coupling portion 22 by means of which it is engaged and guided in a seat 23 of a support 24 and is fixed to the support 24 by means of three screws 26 (see FIG. 4) received in respective slots 27. The slots 27 in the support 24 permit centering and adjustment of the angular position of the stator of the motor 16 with respect to the support 24, in the assembly phase.

Figure 3:
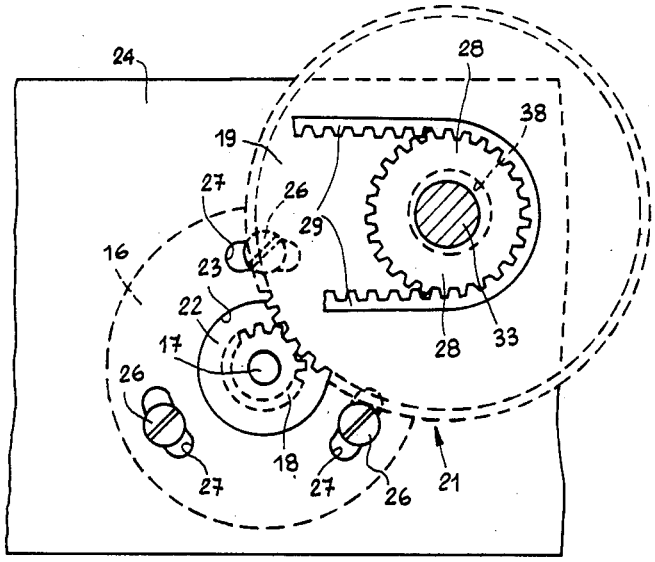
FIG. 3 is a partial front view of some details of the device shown in FIG. 2.

The transmission unit 21 (see FIG. 2) comprises the gear 19 and a toothed pulley 28 which is coaxial with the gear 19 and which is continuously engaged with a toothed belt 29 which in turn is connected to the print unit 13 (see FIG. 1) for displacement thereof in both directions. The gear 19 (see FIG. 2) and the toothed pulley 28 are rigidly connected by a hollow sleeve 31. The transmission unit 21 is rotatable by means of two roller bearing assemblies 32 on a shaft 33. One end 34 of the shaft 33 is fixed to a fixed support 36 and another end 37 passes through an opening 38 in the support 24 and is fixed by means of a screw 39 (see FIG. 4) to an arm 41 of a lever 42 which in turn is pivoted on a pin 43 on the support 24. A spring 44 rotates the lever 42 in the clockwise direction and urges the shaft 33 and thus the transmission unit 21 (see FIG. 3) towards the shaft 17 of the motor 16, holding the gear 19 engaged with the pinion 18.

The toothed belt 29, besides being engaged with the toothed pulley 28, is also engaged with a second toothed pulley 51 (see FIG. 1) which is rotatable on a pin 52 on a bridge lever 53. The lever 53 comprises two projections 54 which are guided and housed in corresponding openings 56 in a support 57. An adjusting screw 58 with a lock nut 59 positions the lever 53 away from or close to the fixed support 57 so as to produce a predetermined tension, for example about 900 grams, in the toothed belt 29. The tension in the toothed belt 29 around the pulley 28 contributes to positioning the transmission unit 21 (see FIG. 2) with respect to the motor 16.

In particular, the tension in the toothed belt 29, which is reduced in accordance with the short lever arm acting thereon, and the force of the spring 44, correpsonding to about 200 grams, generate a force such as to hold the transmission unit 22 constantly urged towards the motor 16 so that the gear 19 is always engaged, without play, with the pinion 18. That provides a self-regulating device which permits the radial clearances between the pinion 18 and the gear 19 to be automatically taken up.

That structure makes it possible to achieve positioning with a high degree of accuracy and in a repetitive manner of the print unit 13 in front of the point of printing on the platen roller 11, even at high speed and after a long period of use. The transmission ratio between the pinion 18 and the gear 19 is 18/96 and that makes it possible to use a d.c. motor 16 of reduced power, with the movement being transmitted silently, even at high speed.

The foregoing structure can be easily provided since the teeth of the pinion 18 and the gear 19 have been so designed as to permit the clearances between the teeth of the two gear systems to be taken up even in the event of wear on the teeth themselves.

Figure 6:
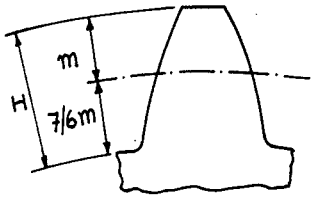
FIG. 6 shows an element for comparison in respect of the detail shown in FIG. 5.

As is known, in standardized tooth configurations (see FIG. 6), a tooth of a height H comprises an addendum, that is to say the part which is between the pitch circle which is shown by the dash-dotted line in FIG. 6, and the tip of the tooth, which is equal to m, and a dedendum, that is to say the part between the base of the tooth and the pitch circle, which is equal to 7/6 m. The complete height is thus: $H=m+7/6$ m, wherein the modulus 'm' denotes the ratio between the pitch circle diameter and the number z of teeth of the gear and is thus: $m=dp/z$.

Figure 5:
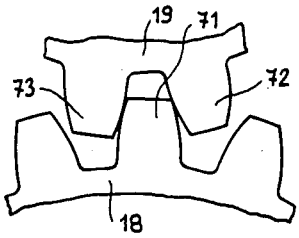
FIG. 5 shows a detail of the device of FIG. 2 on an enlarged scale.

In the case of the teeth on the pinion 18 (see FIG. 5) and the gear 19, the addendum according to the invention is in this case a fraction of the modulus and is always less by about 1/10 than the value of the modulus, while the dedendum retains its value which is equal to seven sixths of the modulus. Therefore the value of H is reduced by at least 1/10 with respect to the standardized value. In addition, between the tip of a tooth as indicated at 71 and the base between two opposite teeth 72 and 73, there is always a gap which is greater than that prescribed in meshing between standardized teeth. That ensures that the teeth of the two gears 18 and 19 will always operate with the side. of the teeth and there will no longer be engagement between the tip of the tooth and the base of the tooth, even with a substantial amount of wear. The foregoing can be clearly seen from FIG. 5 in which, with the addendum reduced in both of the gears 18 and 19, there is a clearly visible gap between the tip and the base of the meshing teeth.

In an alternative embodiment the position of the gear 19 is fixed. The motor 16 is mounted, e.g. on trunnions, so that it can tilt and a spring urges the motor to tilt in the sense forcing the pinion 18 into mesh with the gear 19.

What I claim is:

1. A transport device for a print unit of a printing machine comprising a platen; a toothed belt connected with the print unit for its movement along the platen; a toothed-pulley engaging with said toothed belt; a motor having a stator and a motor shaft rotatable with respect to said stator and fixing a driving pinion thereon; a sleeve unit having a first end portion fixing said toothed pulley and a second end portion fixing a gear wheel in engagement with said driving pinion; a support shaft for rotatably supporting said sleeve unit; a pair of supports displaced apart from each other for supporting the ends of said support shaft, wherein one support fixes one end of the support shaft adjacent to said driving toothed pulley and the other support fixes the stator of said motor adjacent to the other end of the support shaft and said gear wheel, and wherein said toothed pulley is located in the space between the one and the other support; a belt tensioning device for holding a given tension on the engagement of the toothed pulley with said belt; and a back-lash taking-up device for taking up the radial clearance between said driving pinion and said gear wheel, said back-lash taking-up device comprising: guide means operative on said other end of the support shaft for radially adjusting said other end with respect to said motor shaft, wherein the action of the given tension of said belt on the toothed pulley causes the tilting of said unit and the support shaft around said one end for approaching of the toothed gear toward the driving pinion; and spring means operative on said guide means for tilting of said support shaft concurrent with the action of said toothed belt on said sleeve unit.

2. A transport device according to claim 1, wherein said guide means comprise a lever pivoted on said other support and providing an arm fixing the other end of said supporting shaft and means for connection of said lever with spring means.

3. A transport device according to claim 2, wherein said other support comprises a plate on which are fixed the stator of said motor and said lever opposite to said first support, wherein said plate comprises a first and a second opening, wherein said motor shaft projects in front of said one support through said first opening and said support shaft crosses said second opening to enable said other end to be fixed by the arm of said lever opposite to said first support.

4. A transport device for a print unit of a printing machine, comprising a platen roller; a transport motor for movement of the print unit in two directions along the platen roller; a first fixed support on which is rigidly fixed the transport motor; a second fixed support spaced apart from said first support; a support shaft having one end fixed to the second fixed support and an other end free to move transversely with respect to said first fixed support; wherein the first fixed support comprises a fixed pin and a lever which is pivoted on the fixed pin and the free end of said support shaft is fixed on said lever; a transmission unit rotatable on the support shaft and connected through a pinion-gear coupling means with said transport motor, wherein said pinion-gear coupling means comprises a pinion, a gear and a toothed wheel which is coaxial and rigidly connected with said gear; wherein the transport motor comprises a motor shaft on which the pinion is fixed and wherein the transmission unit is pivoted for a tilting movement such as to move said gear into engagement with the pinion; wherein a third fixed support is provided to support a bridge lever and a toothed pulley fulcrumed on said bridge lever, wherein a toothed belt is always engaged with said toothed wheel and said toothed pulley, and wherein a self-regulating device is provided for automatically taking up the radial clearance between the pinion and the gear; wherein said self-regulating device comprises urging means for urging the free end of the support shaft towards the transport motor so as to bring said gear into engagement and in mesh with said pinion; wherein said urging means comprise a spring applied to said lever for holding the free end of the support shaft towards the transport motor and an adjusting screw for positioning the bridge lever away from or close to said third fixed support so as to produce a predetermined tension in said toothed belt; and wherein the tension on the toothed belt around the toothed wheel contributes to hold the free end of said support shaft urged towards said transport motor.

5. A transport device according to claim 4, wherein a hollow sleeve connects the gear and the toothed wheel, and two roller bearing assemblies are mounted on the support shaft, and wherein the transmission unit is rotatable by means of the two roller bearing assemblies on said support shaft.

6. A transport device according to claim 4, wherein the pinion and the gear have teeth, which have a reduced addendum with respect to the standard value of the modulus of the teeth, the reduced addendum of the teeth enabling said self-regulating device to automatically take-up the radial clearance between said pinion and said gear even in the event of wear on said teeth.

7. A transport device according to claim 4, further comprising a lock nut engaged with said adjusting screw to lock said adjusting screw in a predetermined position with respect to said third support.

* * * * *